US008745794B1

(12) United States Patent
McDermott

(10) Patent No.: US 8,745,794 B1
(45) Date of Patent: Jun. 10, 2014

(54) SWADDLING ARTICLE

(71) Applicant: Edison Nation, LLC, Charlotte, NC (US)

(72) Inventor: Julie McDermott, Santa Monica, CA (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 13/796,247

(22) Filed: Mar. 12, 2013

Related U.S. Application Data

(60) Provisional application No. 61/754,560, filed on Jan. 19, 2013.

(51) Int. Cl.
*A41B 13/06* (2006.01)

(52) U.S. Cl.
USPC ..... 5/655; 5/494; 5/482; 5/630; 2/69.5

(58) Field of Classification Search
USPC ..... 5/494, 482, 655, 630; 2/69.5
See application file for complete search history.

(56) References Cited

U.S. PATENT DOCUMENTS 1,802,540 A * 4/1931 Schmidt ..... 2/114
4,688,270 A * 8/1987 Denicola et al. ..... 2/102
5,129,406 A * 7/1992 Magnusen et al. ..... 128/873
5,131,096 A * 7/1992 Olson ..... 2/75
5,147,384 A 9/1992 La Rocca
5,243,724 A 9/1993 Barnes
5,245,717 A 9/1993 Rudy
5,263,975 A * 11/1993 La Rocca ..... 606/234
5,908,439 A 6/1999 Ford et al.
6,269,502 B1 8/2001 Exstrom
6,292,962 B1 9/2001 Dunn et al.
6,393,612 B1 5/2002 Thach et al.
6,513,164 B1 2/2003 Hearns (Continued)

OTHER PUBLICATIONS

Information disclosure statement (IDS) Letter Regarding Common Patent Application(s), dated May 21, 2013.

*Primary Examiner* — William Kelleher
(74) *Attorney, Agent, or Firm* — Tillman Wright, PLLC; James D. Wright; David R. Higgins

(57) ABSTRACT

A method of swaddling a baby includes providing a blanket having a pair of spaced-apart sleeves attached to the blanket and a pair of leg openings that extend fully through the blanket. Each leg opening is located generally beneath a respective one of the sleeves. The method includes: positioning the baby generally between the spaced-apart sleeves; guiding a first arm of the baby into a first one of the spaced-apart sleeves; wrapping a first end flap of the blanket, adjacent to the first one of the spaced-apart sleeves, across the baby's chest; guiding a first leg of the baby, the first leg being on a side of the baby opposite to the first arm, through a first one of the leg openings, the first one of the leg openings being located generally beneath the first one of the spaced-apart sleeves; guiding a second arm of the baby into a second one of the spaced-apart sleeves; wrapping a second end flap of the blanket, adjacent to the second one of the spaced-apart sleeves, across the baby's chest; and guiding a second leg of the baby, the second leg being on a side of the baby opposite to the second arm, through a second one of the leg openings, the second one of the leg openings being located generally beneath the second one of the spaced-apart sleeves.

14 Claims, 13 Drawing Sheets

(56) References Cited

U.S. PATENT DOCUMENTS

| | | | | |
|---|---|---|---|---|
| 6,868,566 | B2 | 3/2005 | Gatten | |
| 6,978,479 | B2 | 12/2005 | Thach | |
| 7,181,789 | B2 * | 2/2007 | Gatten | 5/494 |
| 7,246,392 | B2 | 7/2007 | Schmid et al. | |
| 7,587,769 | B1 * | 9/2009 | McDermott | 5/494 |
| 8,375,486 | B2 * | 2/2013 | Earnest | 5/494 |
| 2002/0026670 | A1 | 3/2002 | Dunn et al. | |
| 2002/0129445 | A1 | 9/2002 | Deering et al. | |
| 2002/0129447 | A1 | 9/2002 | Dunn et al. | |
| 2005/0262633 | A1 | 12/2005 | Haleem | |
| 2006/0200906 | A1 | 9/2006 | Deering et al. | |
| 2009/0165206 | A1 * | 7/2009 | Davis | 5/494 |
| 2012/0110716 | A1 * | 5/2012 | Christensen et al. | 2/69.5 |
| 2012/0284922 | A1 * | 11/2012 | Gangan et al. | 5/494 |
| 2013/0333113 | A1 | 12/2013 | Gotel et al. | |
| 2014/0020177 | A1 * | 1/2014 | Coates | 5/494 |
| 2014/0033430 | A1 * | 2/2014 | Daugherty et al. | 5/494 |

* cited by examiner

SWADDLING ARTICLE

CROSS REFERENCE TO RELATED APPLICATIONS

The present application is a U.S. non-provisional patent application of, and claims priority under 35 U.S.C. §119(e) to, U.S. provisional patent application Ser. No. 61/754,560, filed Jan. 19, 2013, which is expressly incorporated herein by reference in its entirety. Additionally, the entirety of U.S. Pat. No. 7,587,769, issued on Sep. 15, 2009 and entitled "SWADDLING ARTICLE," is expressly incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND

1. Field

The present invention relates to articles of dress and clothing for babies and, more particularly, swaddling blankets.

2. Background

The practice of baby swaddling dates back centuries, and is still common in many cultures. Swaddling involves tightly wrapping a baby securely from shoulders to feet with a small blanket.

Swaddling is useful for soothing and calming a fussy baby. Many believe that a tightly enwrapped baby feels secure because it represents a facsimile of being in the womb. Swaddling also keeps a baby warm, which is important because a newborn cannot regulate body temperature as well as an adult. Swaddling also helps newborns sleep longer because it prevents sudden movements that can cause waking. Other benefits of swaddling are also apparent. For instance, swaddling helps restrain a baby's arms and legs keeping them out of the way of breastfeeding and making the baby easier to hold, and prevents a baby, who has limited control over his arm and leg movements, from scratching himself with his nails.

Some babies need to adjust to swaddling in the beginning. Accordingly, babies must be given the chance to become comfortable with swaddling before the practice is abandoned. If a baby does not seem to like swaddling, it is recommended that one or both of his arms be left free. Proper swaddling, however, requires that the blanket fit snugly, but not so tightly as to impede blood circulation. Swaddling usually works well for babies from birth to about three or four months of age. However, babies who are used to swaddling may enjoy it for a longer period of time.

Swaddling is, accordingly, characterized as tightly enwrapping a baby from shoulders to feet with a small blanket. However, through normal movement a swaddled baby can often loosen the swaddle provided by the blanket and scratch himself with his nails or awaken from sleep. Accordingly, given the benefits of swaddling and the shortcomings of using a small blanket to swaddle a baby, a need exists for a swaddling blanket capable of keeping a baby safely swaddled overnight while keeping the baby pacified and comfortable. This, and other needs, is addressed by one or more aspects of the present invention.

SUMMARY

Broadly defined, the present invention according to a first aspect includes a method of swaddling a baby. A blanket is provided that has a pair of spaced-apart sleeves attached to the blanket and a pair of openings that extend fully through the blanket. Each opening is located generally beneath a respective one of the sleeves. The method includes: positioning the baby generally between the spaced-apart sleeves; guiding a first arm of the baby into a first one of the spaced-apart sleeves; wrapping a first end flap of the blanket, adjacent to the first one of the spaced-apart sleeves, across the baby's chest; guiding a first leg of the baby, the first leg being on a side of the baby opposite to the first arm, through a first one of the openings, the first one of the openings being located generally beneath the first one of the spaced-apart sleeves; guiding a second arm of the baby into a second one of the spaced-apart sleeves; wrapping a second end flap of the blanket, adjacent to the second one of the spaced-apart sleeves, across the baby's chest; and guiding a second leg of the baby, the second leg being on a side of the baby opposite to the second arm, through a second one of the openings, the second one of the openings being located generally beneath the second one of the spaced-apart sleeves.

In a feature of this aspect, the method may further include tucking the first and second end flaps underneath the baby.

In other features of this aspect, the blanket may include a pacifier retaining structure having at least one row of openings, each opening being sized to accommodate a portion of a pacifier; the at least one row of openings may be located along an edge of the blanket; and/or the method may further include placing a portion of a pacifier through a selected one of the at least one row of openings that is adjacent to the mouth of the baby.

Broadly defined, the present invention according to a second aspect includes a method of swaddling a baby.

Broadly defined, the present invention according to a third aspect includes a swaddling blanket substantially as shown and described.

Broadly defined, the present invention according to a fourth aspect includes a swaddling blanket having a pair of openings, each adapted to accommodate the leg of a baby, substantially as shown and described.

Broadly defined, the present invention according to a fifth aspect includes a method of swaddling a baby. A blanket is provided that has a pair of spaced-apart sleeves attached to the blanket and a pair of leg openings that extend fully through the blanket. Each leg opening is located generally beneath a respective one of the sleeves. The method includes: positioning the baby generally between the spaced-apart sleeves; guiding a first arm of the baby into a first one of the spaced-apart sleeves; wrapping a first end flap of the blanket, adjacent to the first one of the spaced-apart sleeves, across the baby's chest; guiding a first leg of the baby, the first leg being on a side of the baby opposite to the first arm, through a first one of the leg openings, the first one of the leg openings being located generally beneath the first one of the spaced-apart sleeves; guiding a second arm of the baby into a second one of the spaced-apart sleeves; wrapping a second end flap of the blanket, adjacent to the second one of the spaced-apart sleeves, across the baby's chest; and guiding a second leg of the baby, the second leg being on a side of the baby opposite to the second arm, through a second one of the leg openings, the second one of the leg openings being located generally beneath the second one of the spaced-apart sleeves.

In features of this aspect, the method may further include tucking the first and second end flaps underneath the baby.

In other features of this aspect, the blanket may include a pacifier retaining structure having at least one row of pacifier-receiving openings, each pacifier-receiving opening being sized to accommodate a portion of a pacifier; the at least one row of pacifier-receiving openings may be located along an edge of the blanket; and/or the method may further include placing a portion of a pacifier through a selected one of the at least one row of pacifier-receiving openings that is adjacent to the mouth of the baby.

In another feature of this aspect, the spaced-apart sleeves may be substantially parallel relative to an upper edge of the blanket.

Broadly defined, the present invention according to a sixth aspect includes a method of swaddling a baby. A blanket is provided that has a pair of spaced-apart sleeves attached to the blanket, a pacifier-retaining structure, and a pair of leg openings that extend fully through the blanket. Each leg opening is located generally beneath a respective one of the sleeves. The method includes: positioning the baby generally between the spaced-apart sleeves; guiding a first arm of the baby into a first one of the spaced-apart sleeves; wrapping a first end flap of the blanket, adjacent to the first one of the spaced-apart sleeves, across the baby's chest; guiding a first leg of the baby, the first leg being on a side of the baby opposite to the first arm, through a first one of the leg openings, the first one of the leg openings being located generally beneath the first one of the spaced-apart sleeves; tucking the first end flap underneath the baby; guiding a second arm of the baby into a second one of the spaced-apart sleeves; wrapping a second end flap of the blanket, adjacent to the second one of the spaced-apart sleeves, across the baby's chest; guiding a second leg of the baby, the second leg being on a side of the baby opposite to the second arm, through a second one of the leg openings, the second one of the leg openings being located generally beneath the second one of the spaced-apart sleeves; and tucking the second end flap underneath the baby.

In features of this aspect, the pacifier retaining structure may include at least one row of pacifier-receiving openings, each pacifier-receiving opening being sized to accommodate a portion of a pacifier; the at least one row of pacifier-receiving openings may be located along an edge of the blanket; the method may further include placing a portion of a pacifier through a selected one of the at least one row of pacifier-receiving openings that is adjacent to the mouth of the baby; and/or the spaced-apart sleeves may be substantially parallel relative to an upper edge of the blanket.

Broadly defined, the present invention according to a seventh aspect includes a method of swaddling a baby. A blanket is provided that has a pair of spaced-apart sleeves attached to the blanket; a pacifier-retaining structure having at least one row of pacifier-receiving openings, and a pair of leg openings that extend fully through the blanket. Each pacifier-receiving opening being sized to accommodate a portion of a pacifier. Each leg opening is located generally beneath a respective one of the sleeves. The method includes: positioning the baby generally between the spaced-apart sleeves; guiding a first arm of the baby into a first one of the spaced-apart sleeves; wrapping a first end flap of the blanket, adjacent to the first one of the spaced-apart sleeves, across the baby's chest; guiding a first leg of the baby, the first leg being on a side of the baby opposite to the first arm, through a first one of the leg openings, the first one of the leg openings being located generally beneath the first one of the spaced-apart sleeves; tucking the first end flap underneath the baby; guiding a second arm of the baby into a second one of the spaced-apart sleeves; wrapping a second end flap of the blanket, adjacent to the second one of the spaced-apart sleeves, across the baby's chest; guiding a second leg of the baby, the second leg being on a side of the baby opposite to the second arm, through a second one of the leg openings, the second one of the leg openings being located generally beneath the second one of the spaced-apart sleeves; tucking the second end flap underneath the baby; and placing a portion of a pacifier through a selected one of the at least one row of pacifier-receiving openings that is adjacent to the mouth of the baby.

In features of this aspect, at least one row of pacifier-receiving openings may be located along an edge of the blanket; and/or the spaced-apart sleeves may be substantially parallel relative to an upper edge of the blanket.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
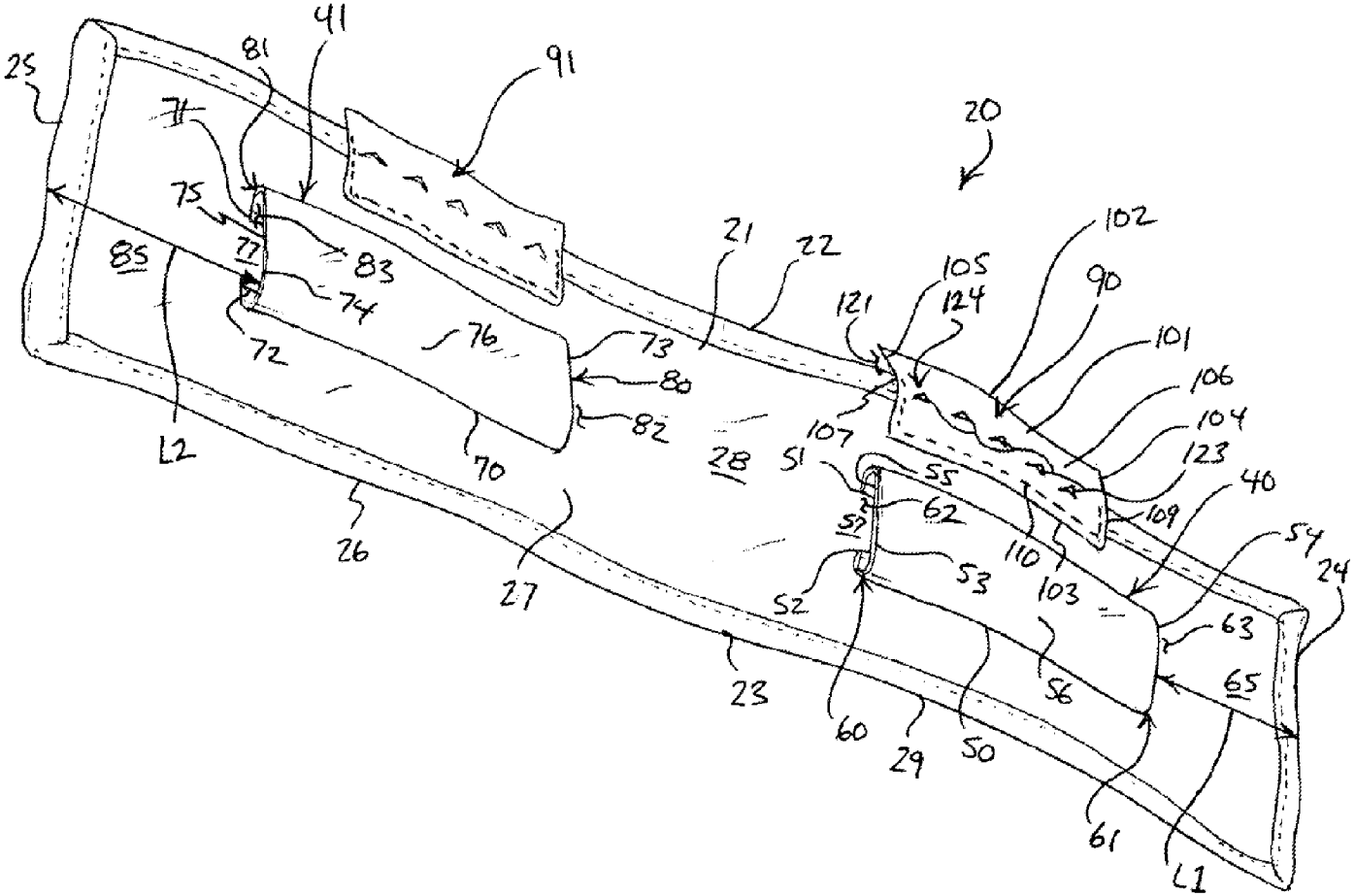
FIG. 1 is a perspective view of an embodiment of a swaddling article in accordance with one or more aspects of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, the preferred embodiments of the present invention are next described. The following description of one or more preferred embodiment(s) is merely exemplary in nature and is in no way intended to limit the invention, its application, or uses.

FIG. 1 is a perspective view of an embodiment of a swaddling article 20 in accordance with one or more aspects of the present invention. The swaddling article 20 includes a soft, broad, flat, pliant blanket 21 having opposed upper and lower edges 22 and 23, opposed side edges 24 and 25, an outer face 26, and an opposed inner face 27, which defines a body-receiving surface or area 28 between sides edges 24 and 25 of blanket 21 extending from upper edge 22 of blanket 21 to lower edge 23 of blanket 21. Outer and inner faces 26 and 27 are opposed, coextensive major faces of blanket 21. Upper edge 22 is substantially parallel relative to lower edge 23, side edge 24 is substantially parallel relative to side edge 25, and upper and lower edges 22 and 23 are substantially parallel relative to side edges 24 and 25. Edges 22, 23, 24, and 25 are each hemmed in the present embodiment and each has a length, and cooperate together forming a perimeter 29 of blanket 21. In the present embodiment, perimeter 29 is generally rectangular in shape, in which blanket 21 is overall generally rectangular in shape. In this respect, the lengths of upper and lower edges 22 and 23 are substantially equal, and the lengths of side edges 24 and 25 are substantially equal and much shorter than the lengths of upper and lower edges 22 and 23 as illustrated. Blanket 21 is formed of soft, pliant woven or unwoven material, such as cotton, polyester, fleece material, or the like or a selected combination of such materials or other similar materials.

Blanket 21 is formed with opposed, spaced-apart arm-receiving sleeves 40 and 41, in accordance with the principle of the invention. In the present embodiment, sleeves 40 and 41 are formed at inner face 27. Sleeve 40 is elongate and is disposed between upper and lower edges 22 and 23 of blanket 21 and between body-receiving area 28 of inner face 27 of blanket 21 and side edge 24 of blanket 21. Sleeve 41 is elongate and is disposed between upper and lower edges 22 and 23 of blanket 21 and between body-receiving area 28 of inner face 27 of blanket 21 and side edge 25 of blanket 21. Sleeves 40 and 41 opposed one another, and are spaced-apart relative to each other each being disposed on either side of body-receiving area 28. Sleeves 40 and 41 are provided to receive the arms of a baby positioned back first against body-receiving area 28 of blanket 21, in which instance sleeve 40 is to receive the left arm of the baby and sleeve 41 is to receive the right arm of the baby. Sleeve 40 is substantially parallel relative to upper edge 22 of blanket 21, and also lower edge 23 of blanket 21. Sleeve 41 is substantially parallel relative to upper edge 22 of blanket 21, and also lower edge 23 of blanket 21. Sleeves 40 and 41 are each located substantially centrally between upper and lower edges 22 and 23 of blanket 21.

Figure 3:
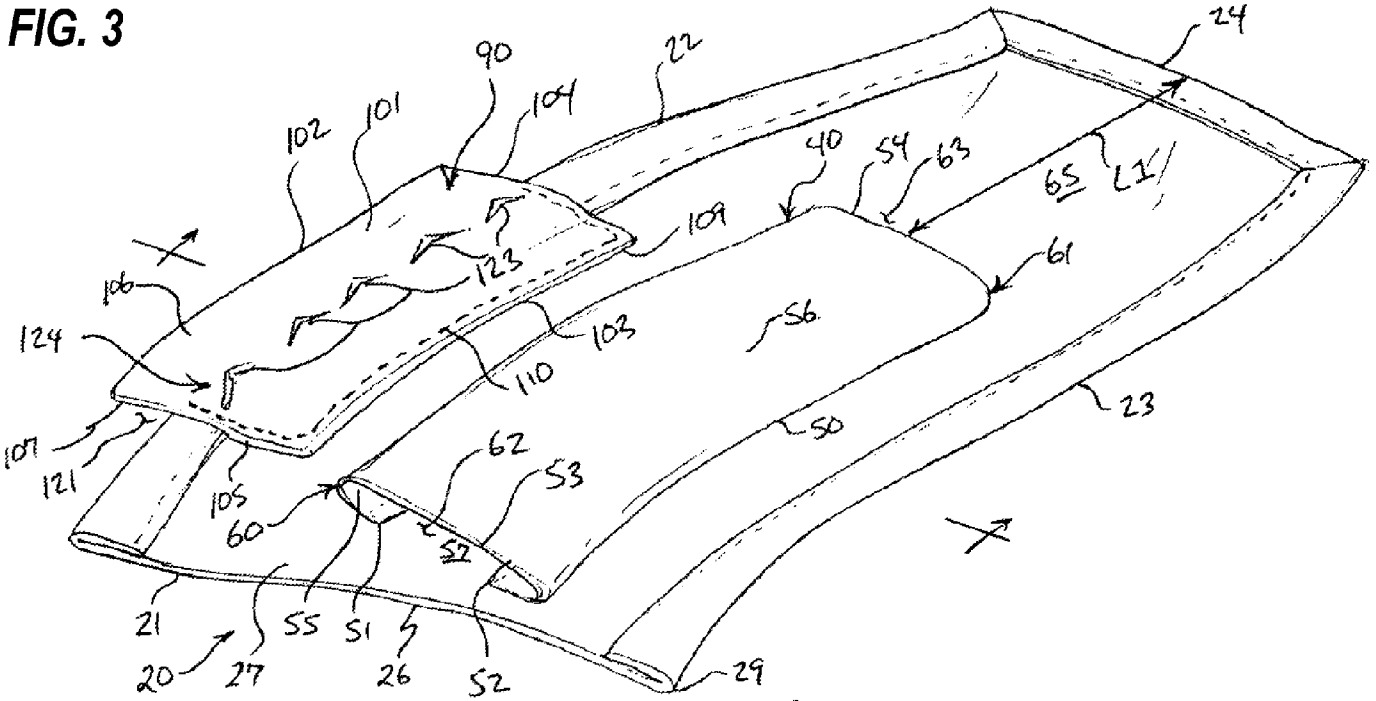
FIG. 3 is an enlarged fragmented perspective view of the swaddling article of FIG. 1.

Referencing FIGS. 1 and 3, in this specific embodiment, sleeve 40 is formed by an elongate, rectangular piece of material 50 having opposed upper and lower end edges 51 and 52, opposed side edges 53 and 54, and opposed inner and outer surfaces 55 and 56. End edges 51 and 52 are applied to inner face 27 of blanket 21, which is also viewed in FIG. 4, and are each secured with stitching and/or a suitable fabric adhesive. End edges 51 and 52 are spaced-apart, are substantially parallel relative to each other, and are each substantially parallel to upper edge 22 of blanket 21 and lower edge 23 of blanket 21. Piece of material 50 extends away from inner face 27 of blanket 21, and inner surface 55 confronts and cooperates with inner face 27 of blanket 21 forming an arm-receiving channel 57 referenced in FIG. 4.

Looking to FIGS. 1 and 3, sleeve 40 has a proximal end denoted generally at 60 and an opposed distal end denoted generally at 61. Proximal end 60 of sleeve 40 is directed toward body-receiving area 28 of inner face 27 of blanket 21, and distal end 61 is directed toward side edge 24 of blanket 21. An opening 62 into channel 57, which is formed by the cooperation between side edge 53 and the confronting portion of inner face 27 of blanket 21, defines proximal end 60 of sleeve 40. An opening 63 into channel 57, which is formed by the cooperation between side edge 54 and the confronting portion of inner face 27 of blanket 21, defines distal end 61 of sleeve 40. Arm-receiving channel 57 extends from proximal end 60 to distal end 61, and is to receive an arm of a baby extending into channel 57 through opening 62 into channel 57 formed at proximal end 60. If desired, distal end 61 of sleeve 40 may be closed. A length L1 of blanket 21 extends from distal end 61 of sleeve 40 to side edge 24 between upper and lower edges 22 and 23. Length L1 of blanket 21 constitutes a flap 65 of blanket 21, in accordance with the principle of the invention.

Like sleeve 40, in this particular embodiment sleeve 41, as viewed in FIG. 1, is formed by an elongate, rectangular piece of material 70 having opposed upper and lower end edges 71 and 72, opposed side edges 73 and 74, and opposed inner and outer surfaces 75 and 76. End edges 71 and 72 are applied to inner face 27 of blanket 21, which is also viewed in FIG. 4, and are each secured with stitching and/or a suitable fabric adhesive. End edges 71 and 72 are spaced-apart, are substantially parallel relative to each other, and are each substantially parallel to upper edge 22 of blanket 21 and lower edge 23 of blanket 21. Piece of material 70 extends away from inner face 27 of blanket 21, and inner surface 75 confronts and cooperates with inner face 27 of blanket 21 forming an arm-receiving channel 77.

Looking to FIGS. 1 and 3, sleeve 41 has a proximal end denoted generally at 80 and an opposed distal end denoted generally at 81. Proximal end 80 of sleeve 41 is directed toward body-receiving area 28 of inner face 27 of blanket 21, and distal end 81 is directed toward side edge 25 of blanket 21. An opening 82 into channel 77, which is formed by the cooperation between side edge 73 and the confronting portion of inner face 27 of blanket 21, defines proximal end 80 of sleeve 41. An opening 83 into channel 77, which is formed by the cooperation between side edge 74 and the confronting portion of inner face 27 of blanket 21, defines distal end 81 of sleeve 41. Arm-receiving channel 77 extends from proximal end 80 to distal end 81, and is to receive an arm of a baby extending into channel 77 through opening 82 into channel 77 formed at proximal end 80. If desired, distal end 81 of sleeve 41 may be closed. A length L2 of blanket 21 extends from distal end 81 of sleeve 41 to side edge 25 between upper and lower edges 22 and 23. Length L2 of blanket 21 constitutes a flap 85 of blanket 21.

With continuing reference to FIGS. 1 and 3, a pacifier retaining structure 90 is formed in blanket 21 adjacent to sleeve 40 proximate to upper edge 22, and a pacifier retaining structure 91 is formed in blanket 21 adjacent to sleeve 41 proximate to upper edge 22. Pacifier retaining structure 90 relates to sleeve 40 and is adapted to receive and retain a pacifier relative to blanket 21 proximate to sleeve 40, in accordance with the principle of the invention. Pacifier retaining structure 91 relates to sleeve 41 and is adapted to receive and retain a pacifier relative to blanket 21 proximate to sleeve 41, in accordance with the principle of the invention. Pacifier retaining structures 90 and 91 are identical, and functional attributes of pacifier retaining structure 90 is discussed below, with the understanding that the ensuing discussion of pacifier retaining structure 90 applies in every respect to pacifier retaining structure 91.

Figure 4:
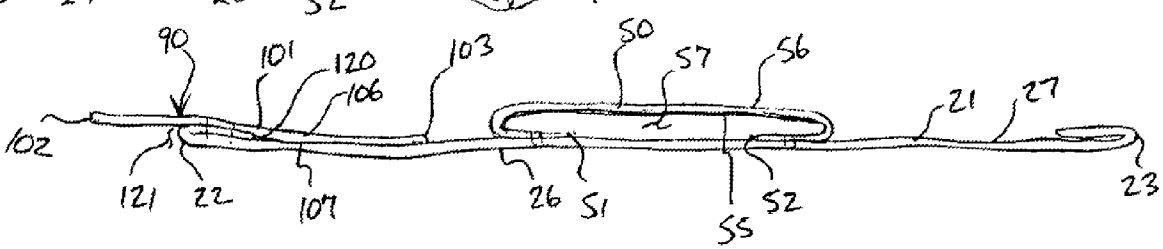
FIG. 4 is a sectional view taken along line 4-4 of FIG. 3.
Figure 5:
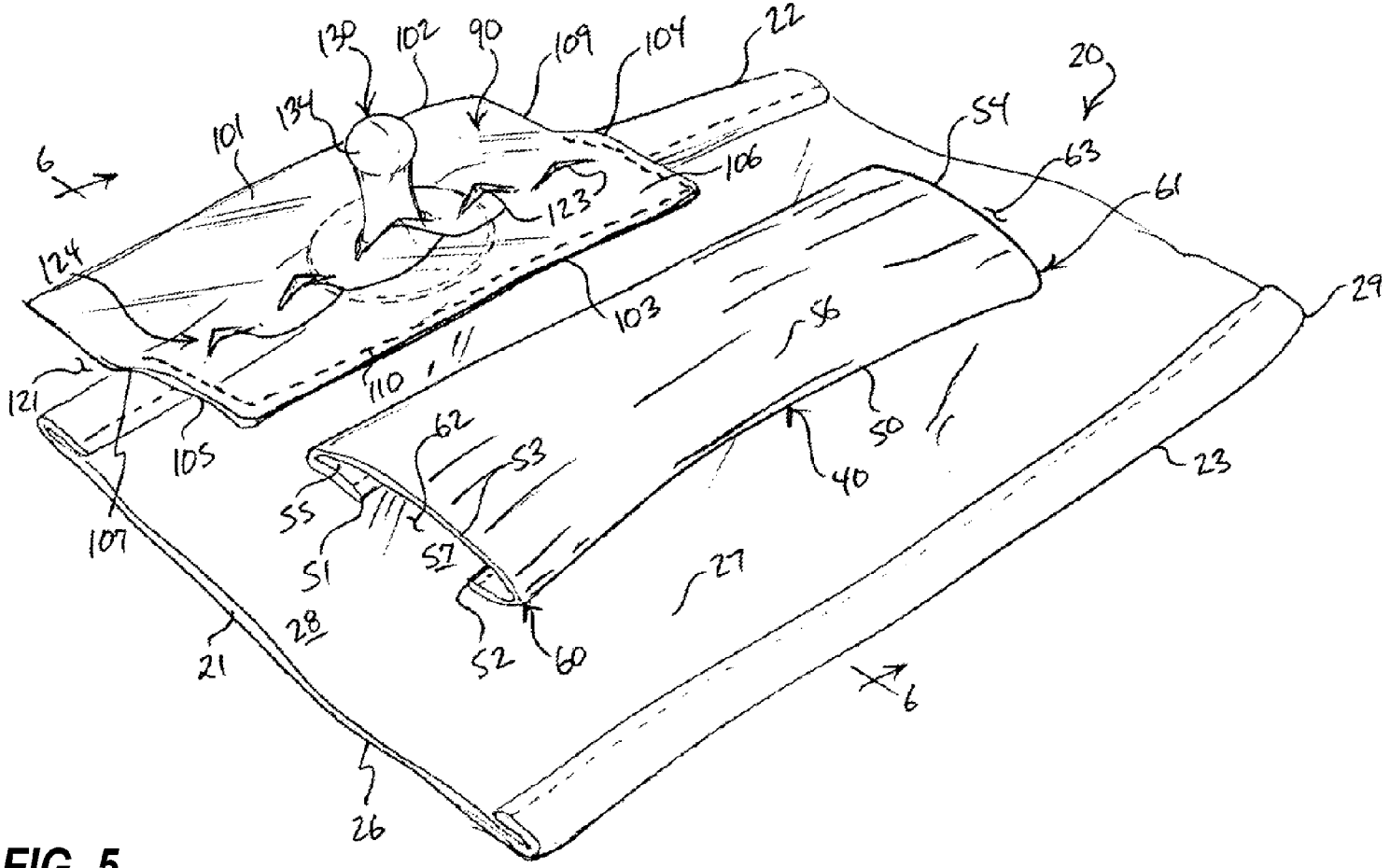
FIG. 5 is a view very similar to the view of FIG. 3, illustrating a pacifier held by a pacifier retaining structure of the swaddling article.
Figure 6:
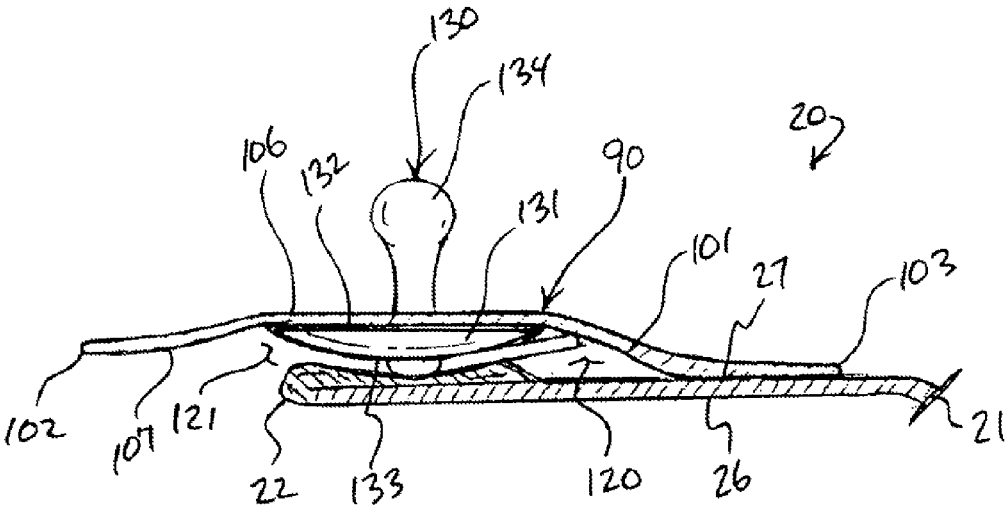
FIG. 6 is a sectional view taken along line 6-6 of FIG. 5.

As seen in FIGS. 1, 3, and 5, pacifier retaining structure 90 consists of a pacifier retaining flap 101 having opposed upper and lower edges 102 and 103, opposed side edges 104 and 105, an outer surface 106, and, as viewed in FIGS. 4 and 6, an opposed inner surface 107. Outer and inner surfaces faces 106 and 107 are opposed, coextensive major faces of flap 101. As viewed in FIGS. 1, 3, and 5, upper edge 102 is substantially parallel relative to lower edge 103, side edge 104 is substantially parallel relative to side edge 105, and upper and lower edges 102 and 103 are substantially parallel relative to side edges 104 and 105. Edges 102, 103, 104, and 105 each have a length, and cooperate together to form a perimeter 109 of flap 101. In the present embodiment, perimeter 109 is generally rectangular in shape, in which flap 101 is overall generally rectangular in shape. In this respect, the lengths of upper and lower edges 102 and 103 are substantially equal, and the lengths of side edges 104 and 105 are substantially equal and much shorter than the lengths of upper and lower edges 102 and 103 as illustrated.

Flap 101 is formed of soft, pliant woven or unwoven material, such as cotton, polyester, fleece material, silk, or the like or a selected combination of such materials or other similar materials. Flap 101 is attached to blanket 21, is considered an extension of blanket 21, and is considered part of blanket 21.

Flap 101 is applied to inner face 27 of blanket 21 in the present embodiment of the invention. Inner surface 107 of flap 101 faces inner faces 27 of blanket 21, lower edge 103 is applied to inner face 27 of blanket between sleeve 40 and upper edge 22 of blanket 21, and flap 101 extends along inner face 27 of blanket 21 and outboard relative to upper edge 22 of blanket 21 to upper edge 102 of flap 101, which is disposed outboard of upper edge 22 of blanket 21. Side edge 104 of flap 101 is directed toward side edge 24 of blanket 21, and side edge 105 of flap 101 is directed toward side edge 25 of blanket 21 as viewed in FIG. 1. Lower edge 103 of flap 101 and approximately half the length of each of side edges 104 and 105 are affixed to inner face 27 of blanket 21 with stitching denoted at 110, although a suitable adhesive may be used, if desired, heat-bonding, etc. A pocket 120, denoted in FIGS. 4 and 6, is formed in pacifier retaining structure 90, which, in the present embodiment, is formed between inner face 27 of blanket 21 and inner surface 107 of flap 101. Pocket 120 extends from side edge 104 of flap 101 to side edge 105 of flap 101, and from lower edge 103 of flap 101 to upper edge 22 of blanket 21 between upper and lower edges 102 and 103 of flap 101. An opening 121 into pocket 120 from inner face 27 of blanket 21 is also formed in pacifier retaining structure 90, and in this instance is formed between upper edge 22 of blanket 21 and inner surface 107 of flap 101, and extends from adjacent to side edge 105 of flap 101 to side edge 105 of flap 101. Flap 101, and pocket 120 and opening 121 formed between upper edge 22 of blanket 21 and sleeve 40, are parallel relative to sleeve 40, oppose sleeve 40 and extend between proximal and distal ends 60 and 61 of sleeve 40, according to the principle of the invention.

Referencing FIGS. 1, 3, and 5, a plurality of equally spaced-apart openings 123 are formed through flap 101, which are arranged in a row 124 between upper and lower edges 102 and 103 of flap 101. Row 124 of openings 123 extends from adjacent to side edge 104 to adjacent to side edge 105, opposes and is disposed proximate to upper edge 22 of blanket 21, and is substantially parallel relative to sleeve 40 and to upper edge 22 of blanket 21. Openings 123 each extend through flap 101 from outer surface 106 to inner surface 107 opposing inner face 27 of blanket 21, and communicate with pocket 101 formed between inner surface 107 of flap 101 and inner face 27 of blanket 21. In the present embodiment there are five openings 123, and less or more may be employed in other embodiments as may be desired.

As previously mentioned, pacifier retaining structures 90 relating to sleeve 40 is adapted to receive and retain a pacifier relative to blanket 21. In FIG. 6 there is seen a conventional and well-known and readily available pacifier 130 consisting of a broad pacifier base or body 131 having opposed inner and outer faces 132 and 133, and a nipple 134 attached to body 131, which extends outwardly and away from inner face 132 of body 131. To apply pacifier 130 to pacifier retaining structure 90 in accordance with the principle of the invention, pacifier 130 is taken up, such as by hand, and is inserted into pocket 120 through opening 121 directing outer face 133 toward inner face 27 of blanket 21 and inner face 132 toward inner surface 107 of flap 101. Nipple 134 is, in turn, directed into and through one of openings 123, as viewed in FIG. 5, in which nipple 134 projects away from inner face 27 of blanket 21 and outer surface 106 of flap 101 so as to be easily taken in by mouth. In FIG. 5 nipple 134 is directed through the central one of openings 123, and yet pacifier 130 may be located elsewhere in pocket 120 for locating nipple 134 relative whichever one of openings 123 one may desire along the length of flap 101 from side edge 104 to side edge 105, in accordance with the principle of the invention.

Figure 2:
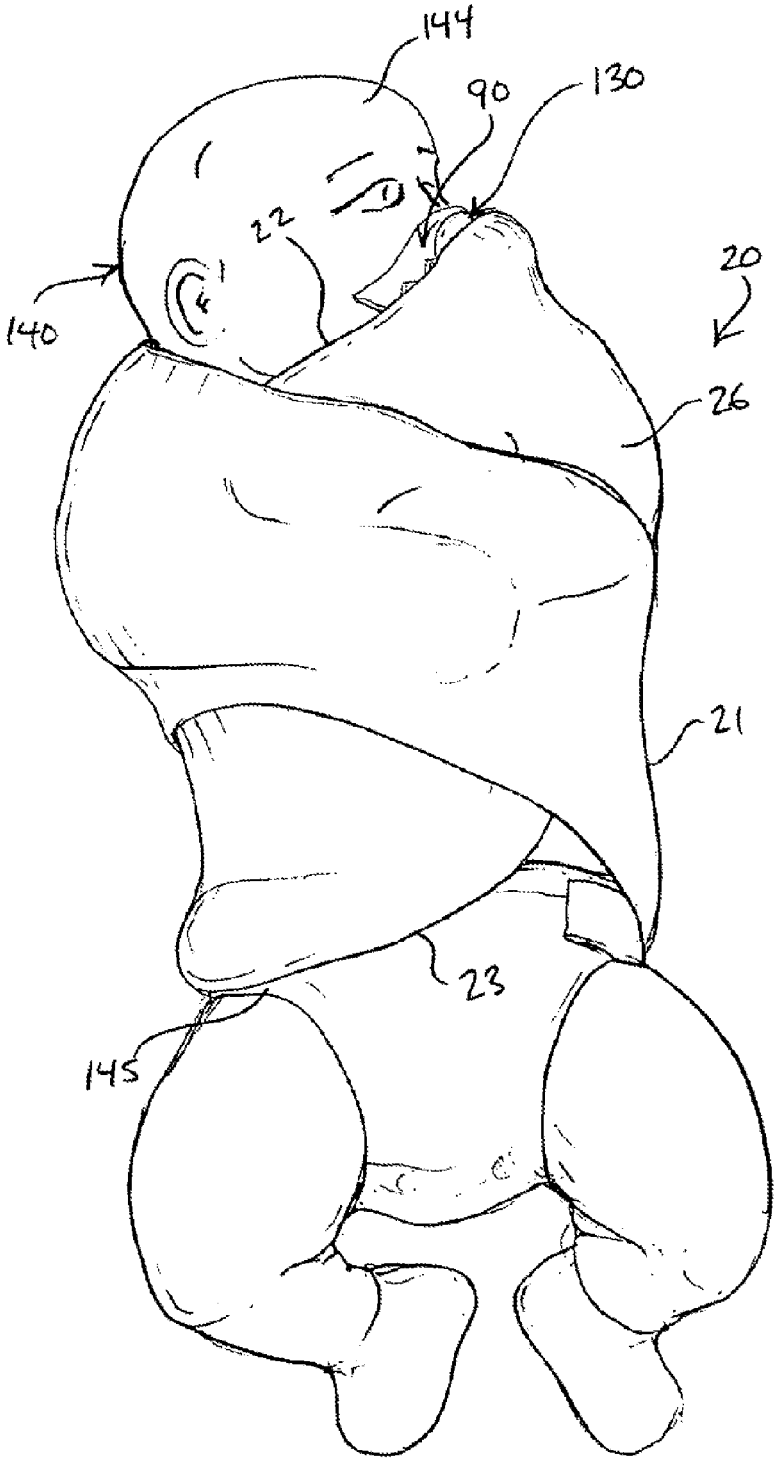
FIG. 2 is a perspective view of a baby swaddled with the swaddling article of FIG. 1.
Figure 7:
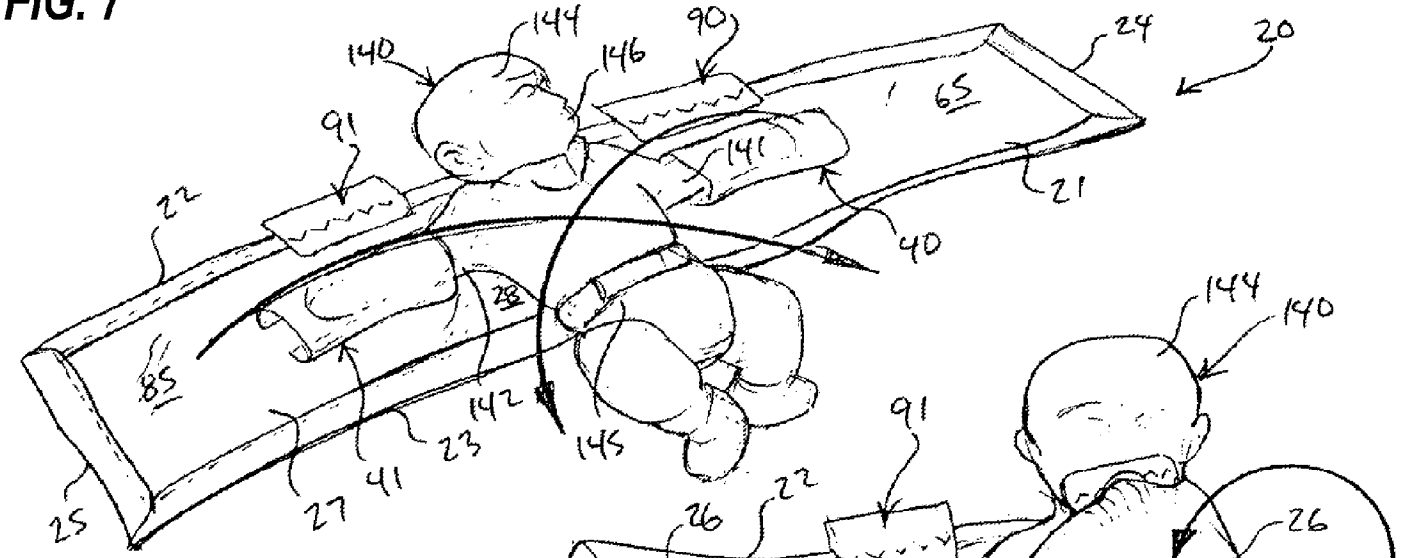
FIG. 7 is a perspective view of a baby initially positioned relative to the swaddling article of FIG. 1.
Figure 8:
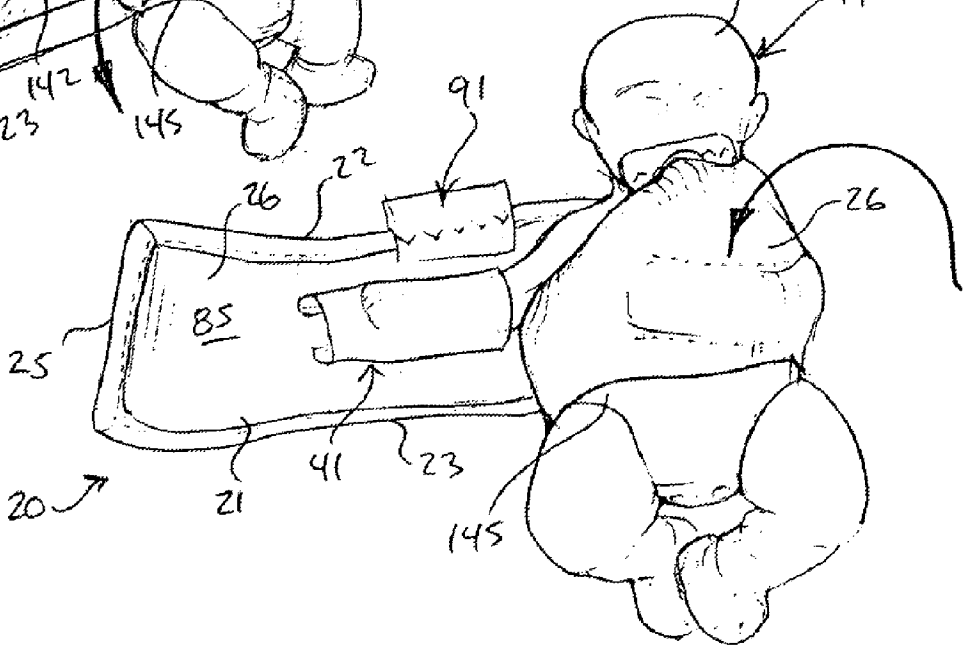
FIG. 8 is a perspective view of the baby of FIG. 7, shown partially swaddled by the swaddling article.

Swaddling article 20 is used to swaddle a baby, such as baby 140 illustrated in FIGS. 2, 7, and 8. As a matter of reference and understanding, baby 140 is generally representative of a human baby ranging in age from newborn to approximately three to four months of age. To swaddle baby 140, swaddling article 20 laid out flat onto a supporting surface, such as the surface of a bed or changing table or floor or other selected supporting surface, directing outer surface 26 against the supporting surface directing inner face 27 of blanket 21 outwardly and upwardly as illustrated in FIG. 7. Next, baby 140 is carefully taken up, such as by the hands of parent or caregiver, and is laid back first against body-receiving area 28 of inner face 27 of blanket 21 between proximal ends 60 and 80 of sleeves 40 and 41, in which head 143 of baby 140 extends upwardly relative to upper edge 22 of blanket 21 and waist 144 of baby 140 is located along lower edge 23 of blanket 21 such that the baby's legs extend downwardly and away from lower edge 23 of blanket 21. Body-receiving area 28 of inner face 27 formed between proximal ends 60 and 80 of sleeves 40 and 41 is sufficiently large to accommodate baby 140 between proximal ends 60 and 80 of sleeves 40 and 41. At this point, left arm 141 of baby 140 is inserted into sleeve 40 through proximal end 60, and right arm 142 of baby 140 is inserted into sleeve 41 through proximal end 80. As viewed in FIG. 7, sleeves 40 and 41 are each sufficiently long so as to prevent the hands of baby 140 from extending outwardly from distal ends 61 and 81 of sleeves 40 and 41, respectively.

To complete the swaddling process in this particular example with reference to FIG. 8, flap 65 formed proximate side edge 24 of blanket 21 is taken up and snugly wrapped over the front of baby 140 drawing inner face 27 of blanket 21 extending from proximate area 28 to side edge 24 across baby's 140 chest and belly between baby's 140 head 143 and waist 144 and flap 65 is tucked underneath the back of baby 140 between the back of baby 140 and body-receiving area 28 of inner face 27 of blanket 21, in which the chest and belly of baby 140 is covered by blanket 21 from his head 143 to his waist 144 and left arm 141 (FIG. 7) of baby 140 is, in turn, drawn across the front of baby 140. In FIG. 8 it is seen that blanket 21 extends along the front of baby 140 from upper edge 22 drawn along the bottom of baby's 140 head 144 to lower edge 23 drawn along baby's 140 waist 145, in which the location of pacifier retaining structure 90 as herein specifically described is such that it is, in turn, drawn across the region of baby's mouth 146 referenced in FIG. 7, in accordance with the principle of the invention. By tucking in flap 65 underneath the back of baby 140 between the back of baby 140 and body-receiving area 28 of inner face 27 of blanket 21, left arm 141 of baby 140 held in sleeve 40 is restrained across the front of baby 140 in turn locating pacifier retaining structure 90 along the region of baby's 140 mouth 146.

At this point, flap 85 formed proximate side edge 25 of blanket 21 is taken up and snugly wrapped over the front of baby 140 drawing inner face of blanket 21 extending from proximate area 28 to side edge 25 across baby's 140 chest and belly across blanket 21 previously snugly wrapped about baby 140 and flap 85 is tucked underneath the back of baby 140 along outer face 26 of blanket 21 extending across the baby's 140 back, in which the chest and belly of baby 140 already covered by blanket 21 is again covered by blanket 21 and right arm 142 of baby 140 is, in turn, drawn across the front of baby 140 relative to baby's 140 left arm 141 thereby swaddling baby 140 as illustrated in FIG. 2. By tucking in flap 85 underneath the back of baby 140, right arm 142 of baby 140 held in sleeve 40 is restrained across the front of baby 140 relative to baby's left arm 141. To un-swaddle baby 140, the foregoing operation described to swaddle baby 140 need only be reversed.

Because the location of pacifier retaining structure 90 as herein specifically described is such that it is drawn across the region of baby's mouth 146 (FIG. 7) when baby 140 is swaddled with swaddling article 20 as herein described, a pacifier, such as pacifier 130, received and retained by pacifier retaining structure 90 as previously described not only retains pacifier 130 preventing it from falling away from blanket 21, but also presents nipple 134 (illustrated only in FIGS. 5 and 6) of pacifier 130 relative to baby's mouth 146 allowing baby 140 to take in nipple 134 of pacifier 130 by mouth at will. Should baby 140 spit out nipple 134 of pacifier 130 received and retained by pacifier retaining structure 90, the provision of pacifier retaining structure 90 retaining pacifier 130 relative to blanket 21 inhibits pacifier 130 from dislodging and falling away from blanket 21, in accordance with the principle of the invention. Also, the soft, pliant characteristic of flap 101 provides a comfortable, soft presentation against the region of the baby's mouth 146.

Openings 123 extending in row 124 across flap 101 of pacifier retaining structure 90 from side edge 104 of flap 101 to side edge 105 of flap 101 define different pacifier receiving locations of pacifier retaining structure 90 across flap 101 from side edge 104 to side edge 105. The different pacifier receiving locations defined by openings 123 accommodates babies of varying sizes and subtle variations in how a parent or caregiver may swaddle a baby with swaddling article 140, and allows a parent or caregiver the freedom to locate a pacifier relative to any one of openings 123 across the length of flap 101 for locating the pacifier at various locations along the length of flap 101 from side edge 104 to side edge 105 for ensuring the pacifier is registered relative to the baby's mouth when the baby is swaddled by swaddling article 20, in accordance with the principle of the invention.

As previously mentioned, pacifier retaining structure 91 is identical in every respect to pacifier retaining structure 91. Accordingly, to utilize pacifier receiving structure 91 in the same manner as pacifier receiving structure 90 baby 140 may be swaddled by first wrapping flap 85 about baby 140 and then flap 65, thereby presenting pacifier retaining structure 91 relative to baby's 140 mouth 146. Furthermore, because sleeves 40 and 41 are each sufficiently long so as to prevent the hands of baby 140 from extending outwardly from distal ends 61 and 81 of sleeves 40 and 41, respectively, baby 140 is prevented from scratching himself with his fingernails while swaddled with swaddling article 20.

After being swaddled with swaddling article 20, it is to be noted that the bottom and legs of baby 140 remain unrestrained as clearly illustrated in FIG. 2. As a result, the baby's diaper may be easily changed as needed without having to un-swaddle baby 140 from swaddling article 20, in accordance with the principle of the invention.

In swaddling baby 140 with swaddling article 20, flap 65 may be tucked under baby's 140 right arm 142 or over baby's 140 right shoulder. Should flap 85 be tucked first, flap 85 may be tucked under baby's 140 left arm 141 or over baby's 140 left shoulder.

Figure 9:
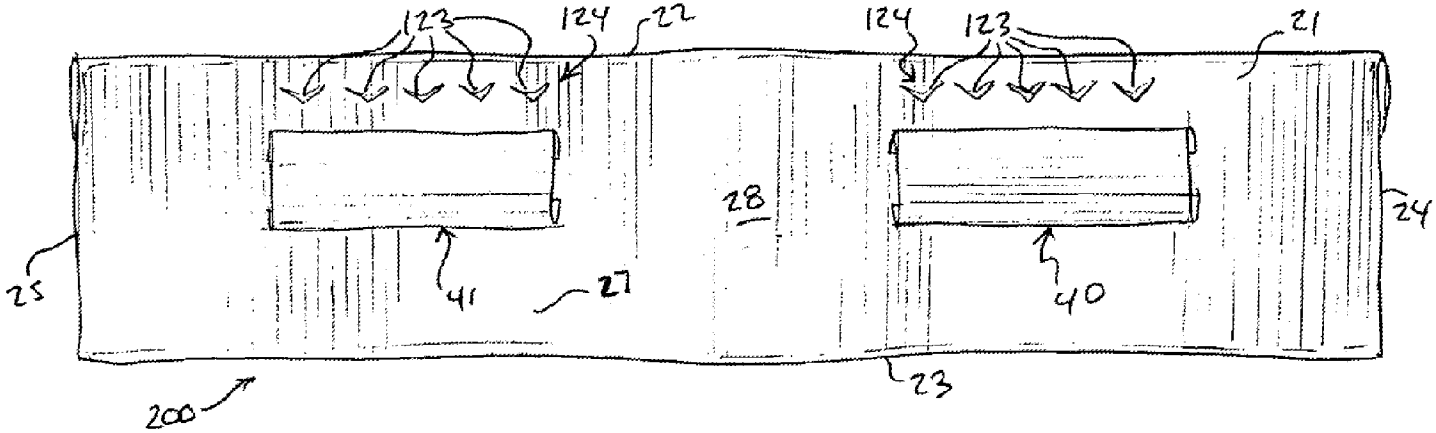
FIG. 9 is a front plan view of another embodiment of a swaddling article in accordance with one or more aspects of the present invention.
Figure 10:
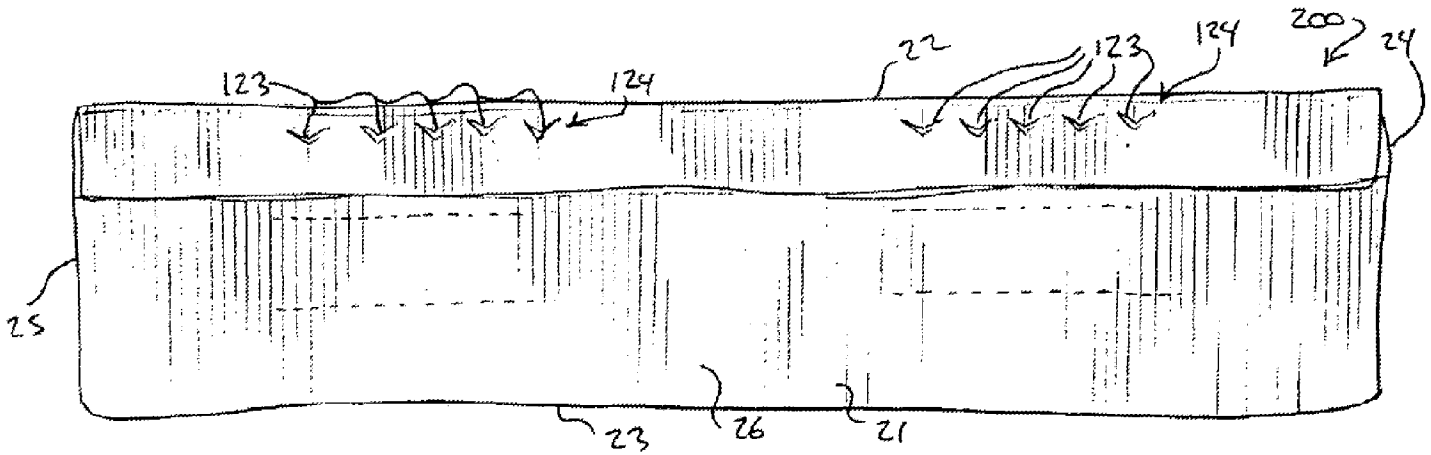
FIG. 10 is a rear plan view of the swaddling article of FIG. 9.
Figure 11:
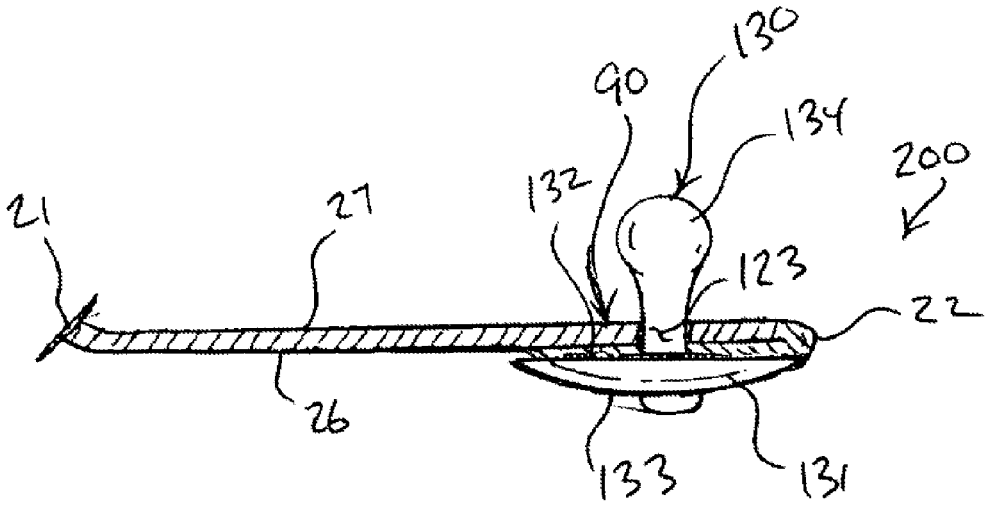
FIG. 11 is a fragmented vertical sectional view of the swaddling article of FIG. 9, illustrating a pacifier held by the swaddling article.

The invention has been described above with reference to a preferred embodiment, and those having regard for the art will readily appreciate that an exemplary swaddling article 20 is disclosed, which is easy to use, easy to construct, and in use provides for the efficient swaddling of a baby and efficiently retains a pacifier relative to the baby's mouth, which may be taken by the baby by mouth at will. Those skilled in the art will recognize that changes and modifications may be made to the embodiment without departing from the nature and scope of the invention. As a matter of example, FIGS. 9 and 10 illustrate front and rear plan views, respectively, of another embodiment of a swaddling article 200 in accordance with one or more aspects of the present invention. In common with swaddling article 20, swaddling article 200 shares blanket 21 including upper edge 22, lower edge 23, side edges 24 and 25, outer face 26 (FIG. 10), inner face 27 (FIG. 9), area 28 (FIG. 9), and sleeves 40 and 41. In the embodiment of swaddling article 200, rows 124 of openings 123 of pacifier retaining structures 90 and 91, although positioned relative to sleeves 40 and 41 in exactly the same manner as with swaddling article 20, row 124 of openings 123 relating to sleeve 40 are formed through blanket 21 from outer face 26 (FIG. 10) to inner face 27 (FIG. 9) between upper edge 22 and sleeve 40, and row 124 of openings 123 relating to sleeve 41 are formed through blanket 21 from outer face 26 (FIG. 10) to inner face 27 (FIG. 9) between upper edge 22 and sleeve 41. In the present embodiment, pacifier retaining structures 90 and 91 lack pockets. To retain a pacifier, such as pacifier 130, pacifier 130 is simply received and held by one of openings 123. In particular, and with respect to each opening 123 of pacifier retaining structures 90 and 91 of swaddling article 200 as illustrated in FIG. 11, pacifier 130 is taken up, such as by hand, and nipple 134 is inserted through the selected opening 123 from outer face 26 of blanket 21 to inner face 27 of blanket 21 bringing inner face 132 of body 131 against outer face 26 of blanket 21, in which nipple 134 extends through and is retained by the designated opening 123 and projects outwardly away from inner face 27 of blanket 21 so as to be easily taken in by mouth. Other than the designated differences between the pacifier retaining structures of swaddling articles 20 and 200, the use and function of swaddling article 200 is identical in every respect to swaddling article 20.

There are some pacifiers that have a handle that is attached to and extends rearwardly relative to the pacifier base or body. One such pacifier is offered under the exemplary SOOTHIE® trademark, and there may be others. The SOOTHIE® pacifier, as a matter of example, is a premium pacifier designed for newborns and babies without teeth who are successfully bottle or breastfeeding. The SOOTHIE® pacifier has a one-piece construction adheres to the American Academy of Pediatrics guidelines. If desired, the outer face of the base of such a pacifier or other similar pacifier may be presented against inner face 27 of blanket 21 of swaddling article 200 and the handle thereof passed into and through one of openings 123, relating either to pacifier structure 90 or pacifier structure 91 as may be desired, so as to retain the pacifier relative to blanket 21 of swaddling article 200, in accordance with the principle of the invention.

Figure 12:
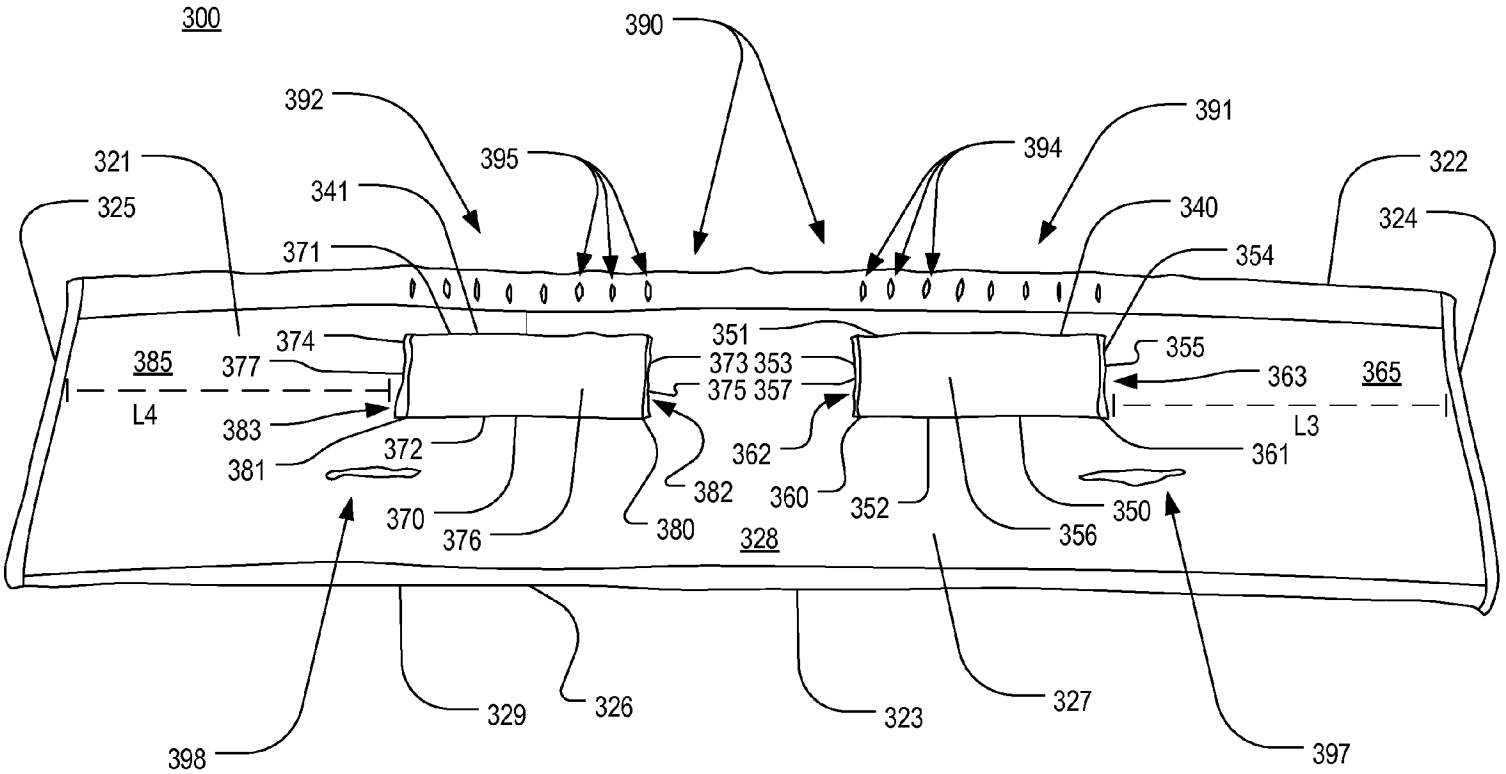
FIG. 12 is a perspective view of still another embodiment of a swaddling article in accordance with one or more aspects of the present invention.

FIG. 12 is a perspective view of still another embodiment of a swaddling article 300 in accordance with one or more aspects of the present invention. The swaddling article 300 includes a soft, broad, flat, pliant blanket 321 having opposed upper and lower edges 322 and 323, opposed side edges 324 and 325, an outer face 326, and an opposed inner face 327, which defines a body-receiving surface or area 328 between sides edges 324 and 325 of blanket 321 extending from upper edge 322 of blanket 321 to lower edge 323 of blanket 321. Outer and inner faces 326 and 327 are opposed, coextensive major faces of blanket 321. Upper edge 322 is substantially parallel relative to lower edge 323, side edge 324 is substantially parallel relative to side edge 325, and upper and lower edges 322 and 323 are substantially parallel relative to side edges 324 and 325. Edges 322, 323, 324, and 325 are each hemmed in the present embodiment and each has a length, and cooperate together forming a perimeter 329 of blanket 321. In the present embodiment, perimeter 329 is generally rectangular in shape, in which blanket 321 is overall generally rectangular in shape. In this respect, the lengths of upper and lower edges 322 and 323 are substantially equal, and the lengths of side edges 324 and 325 are substantially equal and much shorter than the lengths of upper and lower edges 322 and 323 as illustrated. Blanket 321 is formed of soft, pliant woven or unwoven material, such as cotton, polyester, fleece material, or the like or a selected combination of such materials or other similar materials.

Blanket 321 is formed with opposed, spaced-apart arm-receiving sleeves 340 and 341, in accordance with the principle of the invention. In the present embodiment, sleeves 340 and 341 are formed at inner face 327. Sleeve 340 is elongate and is disposed between upper and lower edges 322 and 323 of blanket 321 and between body-receiving area 328 of inner face 327 of blanket 321 and side edge 324 of blanket 321. Sleeve 341 is elongate and is disposed between upper and lower edges 322 and 323 of blanket 321 and between body-receiving area 328 of inner face 327 of blanket 321 and side edge 325 of blanket 321. Sleeves 340 and 341 oppose one another, and are spaced-apart relative to each other each being disposed on either side of body-receiving area 328. Sleeves 340 and 341 are provided to receive the arms of a baby positioned back first against body-receiving area 328 of blanket 321, in which instance sleeve 340 is to receive the left arm of the baby and sleeve 341 is to receive the right arm of the baby. Sleeve 340 is substantially parallel relative to upper edge 322 of blanket 321, and also lower edge 323 of blanket 321. Sleeve 341 is substantially parallel relative to upper edge 322 of blanket 321, and also lower edge 323 of blanket 321. Sleeves 340 and 341 are each located substantially centrally between upper and lower edges 322 and 323 of blanket 321.

Sleeve 340 is formed by an elongate, rectangular piece of material 350 having opposed upper and lower end edges 351 and 352, opposed side edges 353 and 354, and opposed inner and outer surfaces 355 and 356. End edges 351 and 352 are applied to inner face 327 of blanket 321 and are each secured with stitching and/or a suitable fabric adhesive. End edges 351 and 352 are spaced-apart, are substantially parallel relative to each other, and are each substantially parallel to upper edge 322 of blanket 321 and lower edge 323 of blanket 321. Piece of material 350 extends away from inner face 327 of blanket 321, and inner surface 355 confronts and cooperates with inner face 327 of blanket 321 forming an arm-receiving channel 357.

Sleeve 340 has a proximal end denoted generally at 360 and an opposed distal end denoted generally at 361. Proximal end 360 of sleeve 340 is directed toward body-receiving area 328 of inner face 327 of blanket 321, and distal end 361 is directed toward side edge 324 of blanket 321. An opening 362 into channel 357, which is formed by the cooperation between side edge 353 and the confronting portion of inner face 327 of blanket 321, defines proximal end 360 of sleeve 340. An opening 363 into channel 357, which is formed by the cooperation between side edge 354 and the confronting portion of inner face 327 of blanket 321, defines distal end 361 of sleeve 340. Arm-receiving channel 357 extends from proximal end 360 to distal end 361, and is to receive an arm of a baby extending into channel 357 through opening 362 into channel 357 formed at proximal end 360. If desired, distal end 361 of sleeve 340 may be closed. A length L3 of blanket 321 extends from distal end 361 of sleeve 340 to side edge 324 between upper and lower edges 322 and 323. Length L3 of blanket 321 constitutes a flap 365 of blanket 321. Beneath sleeve 340 and positioned, in part, in flap 365 is an opening 397 that extends fully through blanket 321. Opening 397 is sized to fit comfortably around the leg of a baby when the leg is inserted through opening 397 during the swaddling process, as explained in more detail below.

Like sleeve 340, sleeve 341 is formed by an elongate, rectangular piece of material 370 having opposed upper and lower end edges 371 and 372, opposed side edges 373 and 374, and opposed inner and outer surfaces 375 and 376. End edges 371 and 372 are applied to inner face 327 of blanket 321 and are each secured with stitching and/or a suitable fabric adhesive. End edges 371 and 372 are spaced-apart, are substantially parallel relative to each other, and are each substantially parallel to upper edge 322 of blanket 321 and lower edge 323 of blanket 321. Piece of material 370 extends away from inner face 327 of blanket 321, and inner surface 375 confronts and cooperates with inner face 327 of blanket 321 forming an arm-receiving channel 377.

Sleeve 341 has a proximal end denoted generally at 380 and an opposed distal end denoted generally at 381. Proximal end 380 of sleeve 341 is directed toward body-receiving area 328 of inner face 327 of blanket 321, and distal end 381 is directed toward side edge 325 of blanket 321. An opening 382 into channel 377, which is formed by the cooperation between side edge 373 and the confronting portion of inner face 327 of blanket 321, defines proximal end 380 of sleeve 341. An opening 383 into channel 377, which is formed by the cooperation between side edge 374 and the confronting portion of inner face 327 of blanket 321, defines distal end 381 of sleeve 341. Arm-receiving channel 377 extends from proximal end 380 to distal end 381, and is to receive an arm of a baby extending into channel 377 through opening 382 into channel 377 formed at proximal end 380. If desired, distal end 381 of sleeve 341 may be closed. A length L4 of blanket 321 extends from distal end 381 of sleeve 341 to side edge 325 between upper and lower edges 322 and 323. Length L4 of blanket 321 constitutes a flap 385 of blanket 321. Beneath sleeve 341 and positioned, in part, in flap 385 is an opening 398 that extends fully through blanket 321. Opening 398 is sized to fit comfortably around the leg of a baby when the leg is inserted through opening 398 during the swaddling process, as explained in more detail below.

With continuing reference to FIG. 12, a pacifier retaining structure 390 is formed in the blanket 321 proximate to the upper edge 322. Pacifier retaining structure 390 includes two rows 391 and 392 of spaced-apart openings 394 and 395 formed through the blanket 321. The first row 391 of spaced-apart openings 394 is situated generally above and substantially parallel to sleeve 340, and the second row 392 of spaced-apart openings 395 is situated generally above and substantially parallel to sleeve 341. Pacifier retaining structure 390 relates to sleeves 340 and 341 and is adapted to receive and retain a pacifier relative to blanket 321 proximate to sleeves 340 and 341. The rows 391 and 392 may include any desired quantity of openings 394 and 395. In one contemplated embodiment, each row 391 and 392 includes eight equally spaced-apart openings 394 and 395. Other aspects and features of the pacifier retaining structure 390, including the use and function thereof, are the same or similar to aspects and features of the pacifier retaining structures 90 and 91, which are described above in connection with FIGS. 1-11.

Openings 394 and 395 of the pacifier retaining structure 390 are adapted to accommodate a portion of a pacifier. In one contemplated embodiment, a nipple portion of a pacifier is positioned through one of the openings 394 and 395 so as to be easily taken in by mouth when the baby is swaddled. In another contemplated embodiment, a handle portion of a pacifier is positioned through one of the openings 394 and 395 so as to permit the nipple to be easily taken in by mouth when the baby is swaddled. In either case, the pacifier can be positioned relative to whichever of openings 394 and 395 is located adjacent to the baby's mouth. When the baby is swaddled with the swaddling article 300, the pacifier retaining structure 390 helps to retain the pacifier in proper position so that the baby can be soothed by the pacifier while swaddled.

Figure 13:
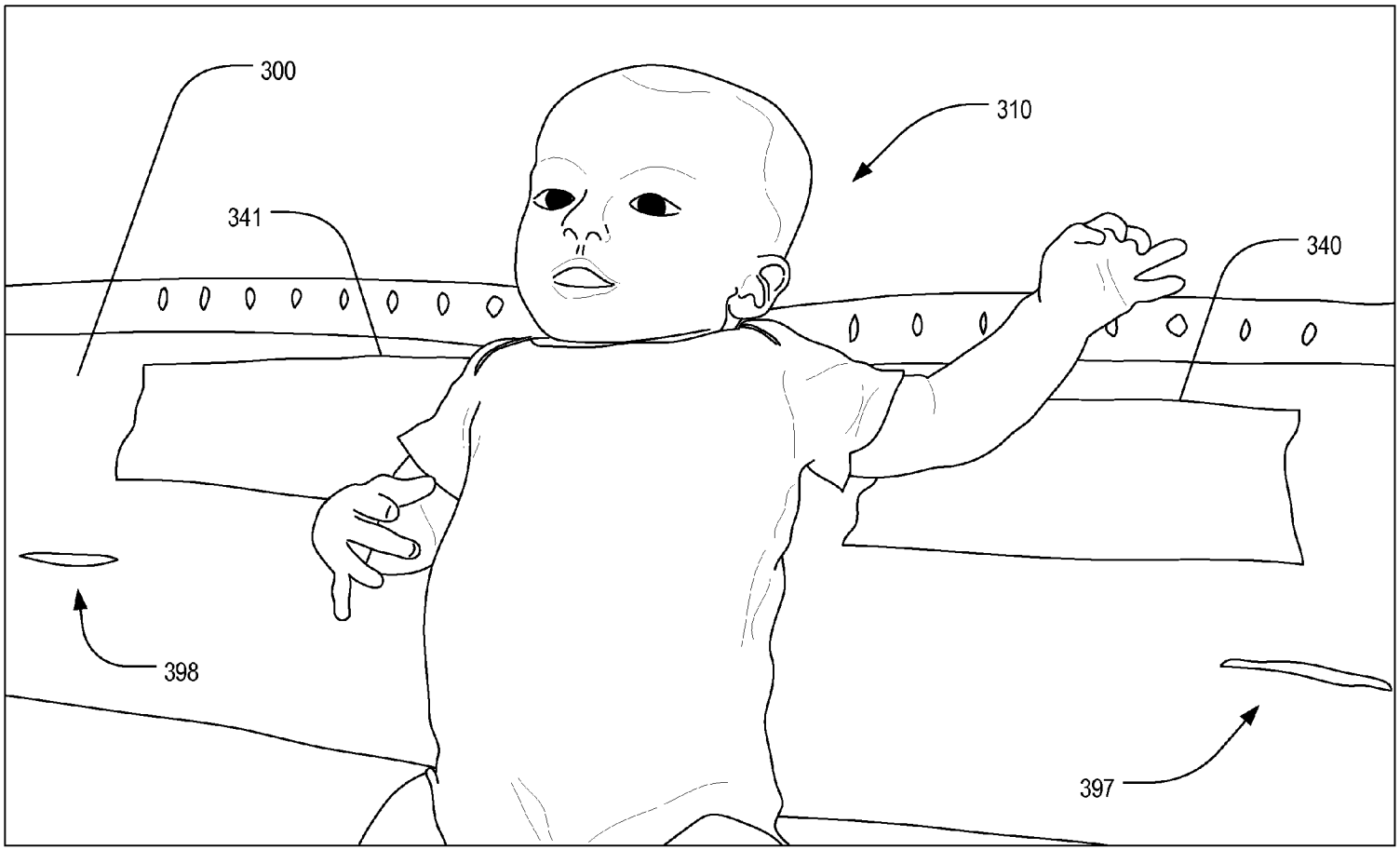
FIG. 13 is a perspective view of a baby initially positioned relative to the swaddling article of FIG. 12.
Figure 14:
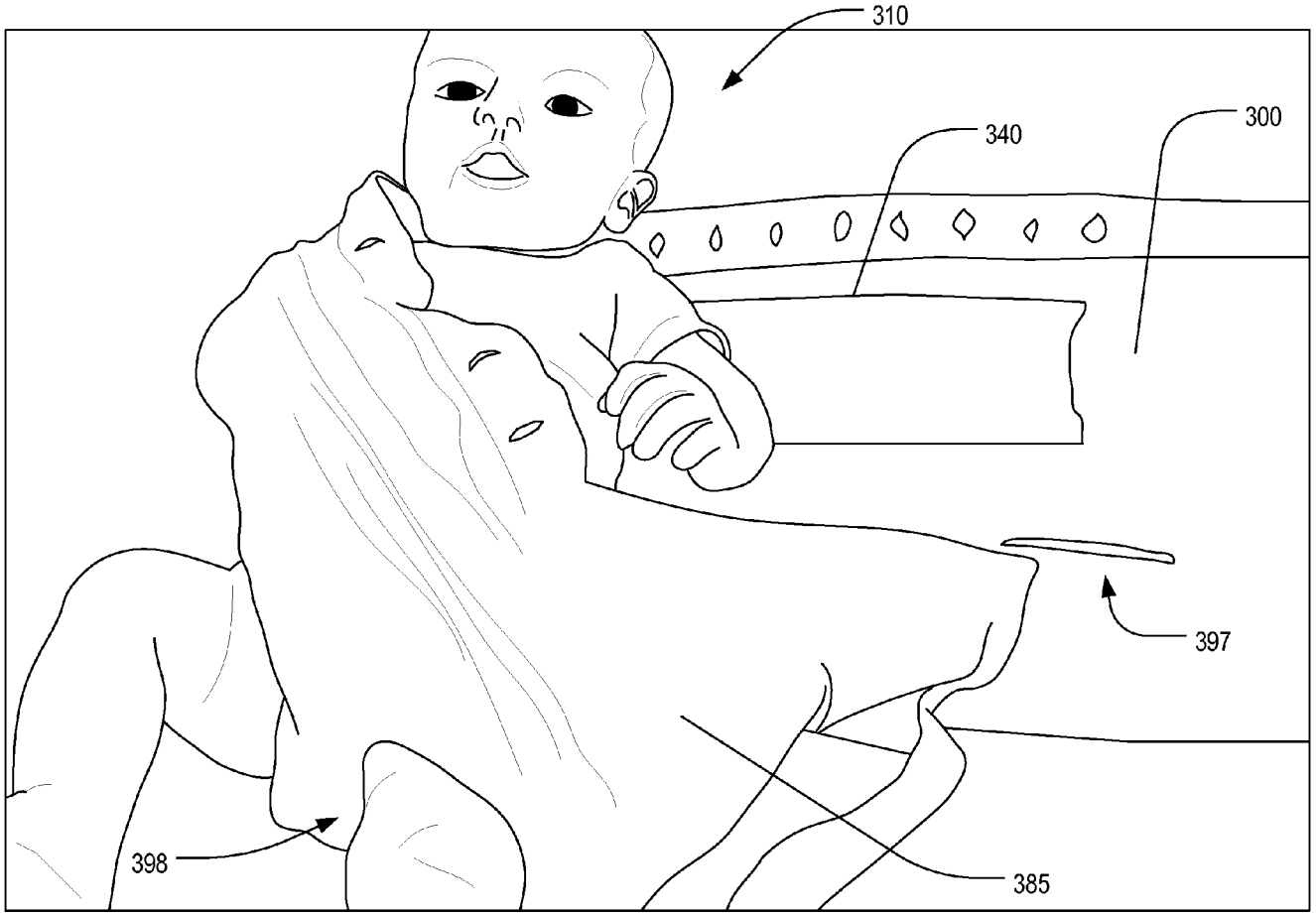
FIGS. 14 and 15 are perspective views of the baby shown partially swaddled by the swaddling article of FIG. 12.
Figure 15:
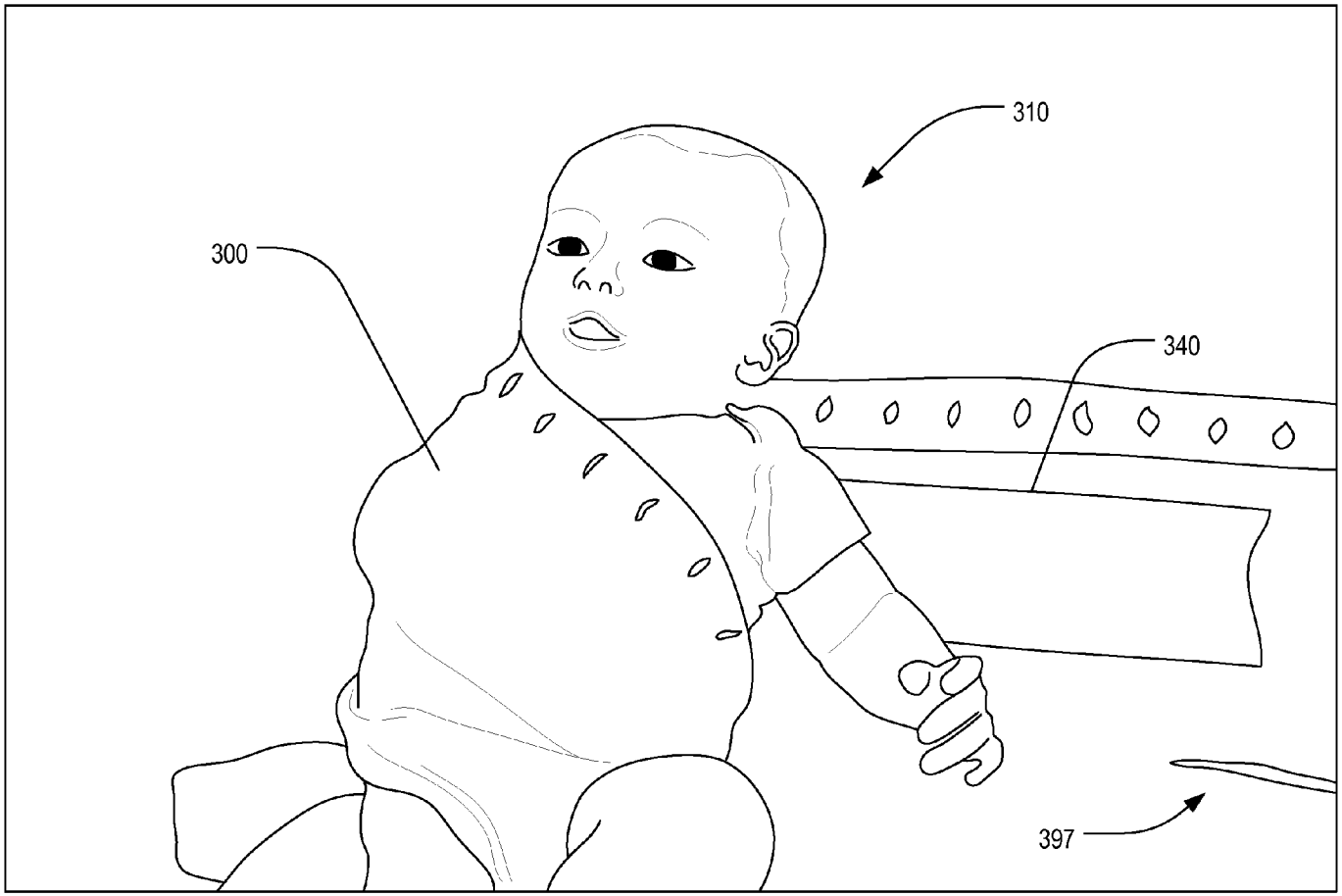
Figure 16:
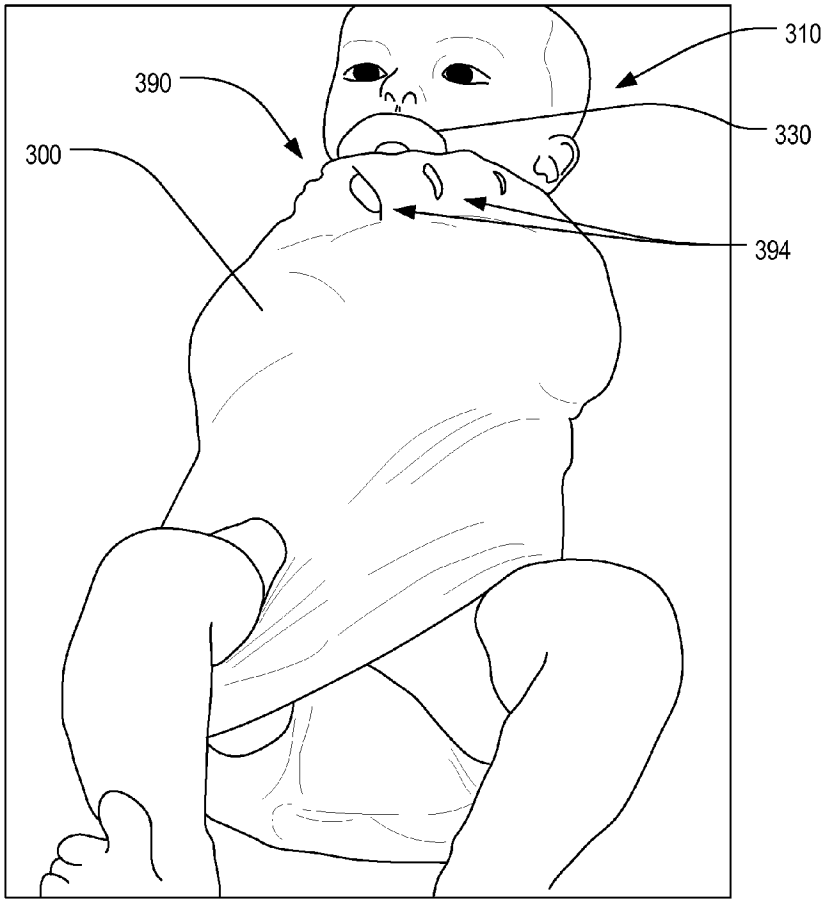
FIG. 16 is a perspective view of the baby shown fully swaddled by the swaddling article of FIG. 12.

FIGS. 13-16 illustrate a method of swaddling a baby 310 using swaddling article 300. FIG. 13 is a perspective view of baby 310 initially positioned relative to the swaddling article 300 of FIG. 12. FIGS. 14 and 15 are perspective views of baby 310 shown partially swaddled by the swaddling article 300 of FIG. 12. FIG. 16 is a perspective view of baby 310 shown fully swaddled by the swaddling article 300 of FIG. 12. As a matter of reference and understanding, baby 310 is generally representative of a human baby ranging in age from newborn to approximately three to four months of age.

With reference to FIGS. 12-16, swaddling article 300 is laid out flat onto a supporting surface, such as the surface of a bed or changing table or floor or other selected supporting surface, directing outer surface 326 against the supporting surface and directing inner face 327 of blanket 321 outwardly and upwardly. Next, baby 310 is carefully taken up, such as by the hands of parent or caregiver, and is laid back first against body-receiving area 328 of inner face 327 of blanket 321 generally between proximal ends 360 and 380 of sleeves 340 and 341, in which the baby's head extends upwardly relative to upper edge 322 of blanket 321 and the baby's waist is located along lower edge 323 of blanket 321 such that the baby's legs extend downwardly and away from lower edge 323 of blanket 321.

The baby's right arm is inserted into sleeve 341 through proximal end 380. As illustrated in FIG. 14, flap 385 is taken up and snugly wrapped over the front of baby 310 such that the inner face 327 of blanket 321 extends across the baby's chest and belly. The baby's left leg is placed through opening 398, and the blanket 321 is pulled snugly against baby 310. As illustrated in FIG. 15, flap 385 is tucked underneath baby 310 between the baby's back and the body-receiving area 328 of inner face 327 of blanket 321. The baby's chest and belly are covered by blanket 321 and the baby's right arm is drawn across the baby's front. The blanket 321 is held in position both by the flap 385 being tucked underneath the baby's back and by the baby's left leg extending through opening 398.

The baby's left arm is inserted into sleeve 340 through proximal end 360. Sleeves 340 and 341 are each sufficiently long so as to prevent the baby's hands from extending outwardly from distal ends 361 and 381 of sleeves 340 and 341, respectively. Flap 365 is taken up and snugly wrapped over the front of baby 310 such that the inner face 327 of blanket 321 extends across the baby's chest and belly. The baby's right leg is placed through opening 397, and the blanket 321 is pulled snugly against baby 310. As illustrated in FIG. 16, flap 365 is tucked underneath baby 310. The weight of baby 310 helps to retain flap 365 underneath baby 310, thereby keeping baby 310 safely swaddled. The baby's chest and belly are covered by blanket 321 and the baby's left arm is drawn across the baby's front, generally over or adjacent to the baby's right arm. The blanket 321 is held in position both by the flap 365 being tucked underneath the baby's back and by the baby's right leg extending through opening 397.

Though the swaddling process using swaddling article 300 is described above with respect to the baby's right arm being swaddled first, it is contemplated that the swaddling process can be implemented in reverse manner, with the baby's left arm being swaddled first, followed by the baby's right arm.

When swaddled with swaddling article 300, the baby's chest and belly are effectively covered by both end flaps 365 and 385 of blanket 321. The baby's arms are restrained comfortably in front of baby within sleeves 340 and 341, and the baby's legs are tucked through openings 397 and 398. With the baby's legs extending through openings 397 and 398, the blanket is effectively kept away from the baby's head and neck, and the blanket 321 is much less likely to be removed or unswaddled inadvertently by the baby's movement. To unswaddle baby 310, the foregoing operation described to swaddle baby 310 need only be reversed.

As further illustrated in FIG. 16, pacifier retaining structure 390 is, in turn, drawn across the region of baby's mouth when the baby 310 is swaddled with swaddling article 300. In this regard, a portion of pacifier 330 can be received and retained by pacifier retaining structure 390, which effectively prevents the pacifier 330 from falling away from blanket 321. Openings 394 and 395 define different pacifier receiving locations of pacifier retaining structure 390. The different pacifier receiving locations defined by openings 394 and 395 accommodates babies of varying sizes and subtle variations in how a parent or caregiver may swaddle a baby with swaddling article 310. Furthermore, the variety of openings 394 and 395 allows a parent or caregiver the freedom to locate a pacifier 330 relative to any one of openings 394 and 395 for ensuring the pacifier 330 is in proper position relative to the baby's mouth when the baby is swaddled by swaddling article 310.

When pacifier 330 is retained within one of openings 394 and 395, the nipple of pacifier 330 is presented in such a way relative to baby's mouth such that the baby 310 can take in the nipple by mouth at will. Should baby 310 spit out the nipple of pacifier 330, the pacifier retaining structure 390 inhibits pacifier 130 from dislodging and falling away from blanket 321.

As pacifier retaining structure 390 includes two rows 391 and 392 of spaced-apart openings 394 and 395, it is contemplated that the pacifier retaining structure 390 can be utilized to retain a pacifier 330 irrespective of which flap 365 and 385 is wrapped across the baby's chest first.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof

What is claimed is:

1. A method of swaddling a baby, the method comprising:

providing a blanket having a pair of spaced-apart sleeves attached to the blanket and a pair of leg openings that extend fully through the blanket, each leg opening being located generally beneath a respective one of the sleeves;

positioning the baby generally between the spaced-apart sleeves;

guiding a first arm of the baby into a first one of the spaced-apart sleeves;

wrapping a first end flap of the blanket, adjacent to the first one of the spaced-apart sleeves, across the baby's chest;

guiding a first leg of the baby, the first leg being on a side of the baby opposite to the first arm, through a first one of the leg openings, the first one of the leg openings being located generally beneath the first one of the spaced-apart sleeves;

guiding a second arm of the baby into a second one of the spaced-apart sleeves;

wrapping a second end flap of the blanket, adjacent to the second one of the spaced-apart sleeves, across the baby's chest; and guiding a second leg of the baby, the second leg being on a side of the baby opposite to the second arm, through a second one of the leg openings, the second one of the leg openings being located generally beneath the second one of the spaced-apart sleeves.

2. The method of claim 1, further comprising tucking the first and second end flaps underneath the baby.

3. The method of claim 1, wherein the blanket includes a pacifier retaining structure having at least one row of pacifier-receiving openings, each pacifier-receiving opening being sized to accommodate a portion of a pacifier.

4. The method of claim 3, wherein the at least one row of pacifier-receiving openings is located along an edge of the blanket.

5. The method of claim 3, further comprising placing a portion of a pacifier through a selected one of the at least one row of pacifier-receiving openings that is adjacent to the mouth of the baby.

6. The method of claim 1, wherein the spaced-apart sleeves are substantially parallel relative to an upper edge of the blanket.

7. A method of swaddling a baby, the method comprising:

providing a blanket having a pair of spaced-apart sleeves attached to the blanket, a pacifier-retaining structure, and a pair of leg openings that extend fully through the blanket, each leg opening being located generally beneath a respective one of the sleeves;

positioning the baby generally between the spaced-apart sleeves;

guiding a first arm of the baby into a first one of the spaced-apart sleeves;

wrapping a first end flap of the blanket, adjacent to the first one of the spaced-apart sleeves, across the baby's chest;

guiding a first leg of the baby, the first leg being on a side of the baby opposite to the first arm, through a first one of the leg openings, the first one of the leg openings being located generally beneath the first one of the spaced-apart sleeves;

tucking the first end flap underneath the baby;

guiding a second arm of the baby into a second one of the spaced-apart sleeves;

wrapping a second end flap of the blanket, adjacent to the second one of the spaced-apart sleeves, across the baby's chest;

guiding a second leg of the baby, the second leg being on a side of the baby opposite to the second arm, through a second one of the leg openings, the second one of the leg openings being located generally beneath the second one of the spaced-apart sleeves; and tucking the second end flap underneath the baby.

8. The method of claim 7, wherein the pacifier retaining structure includes at least one row of pacifier-receiving openings, each pacifier-receiving opening being sized to accommodate a portion of a pacifier.

9. The method of claim 7, wherein the at least one row of pacifier-receiving openings is located along an edge of the blanket.

10. The method of claim 7, further comprising placing a portion of a pacifier through a selected one of the at least one row of pacifier-receiving openings that is adjacent to the mouth of the baby.

11. The method of claim 7, wherein the spaced-apart sleeves are substantially parallel relative to an upper edge of the blanket.

12. A method of swaddling a baby, the method comprising:

providing a blanket having:

a pair of spaced-apart sleeves attached to the blanket;

a pacifier-retaining structure having at least one row of pacifier-receiving openings, each pacifier-receiving opening being sized to accommodate a portion of a pacifier; and a pair of leg openings that extend fully through the blanket, each leg opening being located generally beneath a respective one of the sleeves;

positioning the baby generally between the spaced-apart sleeves;

guiding a first arm of the baby into a first one of the spaced-apart sleeves;

wrapping a first end flap of the blanket, adjacent to the first one of the spaced-apart sleeves, across the baby's chest;

guiding a first leg of the baby, the first leg being on a side of the baby opposite to the first arm, through a first one of the leg openings, the first one of the leg openings being located generally beneath the first one of the spaced-apart sleeves;

tucking the first end flap underneath the baby;

guiding a second arm of the baby into a second one of the spaced-apart sleeves;

wrapping a second end flap of the blanket, adjacent to the second one of the spaced-apart sleeves, across the baby's chest;

guiding a second leg of the baby, the second leg being on a side of the baby opposite to the second arm, through a second one of the leg openings, the second one of the leg openings being located generally beneath the second one of the spaced-apart sleeves;

tucking the second end flap underneath the baby; and placing a portion of a pacifier through a selected one of the at least one row of pacifier-receiving openings that is adjacent to the mouth of the baby.

13. The method of claim 12, wherein the at least one row of pacifier-receiving openings is located along an edge of the blanket.

14. The method of claim 12, wherein the spaced-apart sleeves are substantially parallel relative to an upper edge of the blanket.

* * * * *